US005251820A

United States Patent [19]

Ho

[11] Patent Number: 5,251,820

[45] Date of Patent: Oct. 12, 1993

[54] FLEXIBLE ANGLE SPRAY BOTTLE DEVICE

[76] Inventor: Tze H. Ho, 3101 Montezuma Ave., Alhambra, Calif. 91803

[21] Appl. No.: 932,420

[22] Filed: Aug. 19, 1992

[51] Int. Cl.[5] ..... B05B 15/08; B05B 9/043

[52] U.S. Cl. ..... 239/280.5; 239/289; 239/333; 239/587.1; 239/588; 222/527

[58] Field of Search ..... 239/587.1, 588, 280, 239/280.5, 289, 333; 222/383, 527

[56] References Cited

U.S. PATENT DOCUMENTS

| | | | |
|---|---|---|---|
| 553,726 | 1/1896 | True | 239/588 X |
| 973,810 | 10/1910 | Regan | 239/587.1 X |
| 1,488,084 | 3/1924 | Yonce . | |
| 1,537,566 | 5/1925 | Temple | 239/588 X |
| 2,331,014 | 10/1943 | Brown | 239/587.1 X |
| 2,553,379 | 5/1951 | Peterlin | 239/280.5 |
| 2,719,753 | 10/1955 | Parrott . | |
| 2,873,999 | 2/1959 | Webb | 239/280.5 X |
| 3,032,357 | 5/1962 | Shames et al. | 239/588 X |
| 3,084,872 | 4/1963 | Corning | 239/333 |
| 4,027,433 | 6/1977 | Hockett | 239/588 X |
| 4,397,420 | 8/1983 | Jacobs | 239/154 |
| 4,403,737 | 9/1983 | Hancock | 239/154 |
| 4,407,454 | 10/1983 | Massey | 239/154 |
| 4,795,100 | 1/1989 | Purtell et al. | 239/588 X |

FOREIGN PATENT DOCUMENTS

| | | | |
|---|---|---|---|
| 210522 | 5/1956 | Australia | 239/280.5 |
| 912140 | 5/1954 | Fed. Rep. of Germany | 239/588 |

*Primary Examiner*—Andres Kashnikow
*Assistant Examiner*—William Grant
*Attorney, Agent, or Firm*—Roberts and Quiogue

[57] ABSTRACT

A portable spray apparatus including a bottle reservoir for holding fluid, a manually actuatable pump secured to the bottle reservoir, and an elongated fluid conveying tube having one end connected to the output of the pump and being in the form of a flexible loop section and an elongated output section, wherein the loop section is between the pump output and the output section. The output section of the tube is supported by an arm assembly that is pivotally supported by a support rack which allows the support arm to be positioned at different angular positions.

3 Claims, 1 Drawing Sheet

FLEXIBLE ANGLE SPRAY BOTTLE DEVICE

BACKGROUND OF THE INVENTION

The subject invention is directed generally to portable spraying apparatus, and more particularly to a spray bottle having a variable angle extended nozzle.

Spray bottles are commonly utilized for watering plants and/or misting plant foliage. Known spray bottle designs generally include bottle cap supported manually actuated pumps having integral nozzles. That is, the integral pump/nozzle assembly is positioned over the bottle opening and secured thereto by a bottle cap. A consideration with known spray bottle designs is the need to bring the pump/nozzle assembly close to the intended spray target. As a result, a user needs to employ different postures in watering plants located at different elevations. The need to continuously change posture is time consuming, tiresome, and potentially injurious, for example wherein a person needs to bend or crouch to water a low plant.

SUMMARY OF THE INVENTION

It would therefore be an advantage to provide to provide a portable spray apparatus that avoids or reduces the need for to adopt different postures in watering plants located at different elevations.

Another advantage would be to provide a portable spray apparatus that allows a user to water plants at different elevations while being in a comfortable posture.

The foregoing and other advantages are provided by the invention in a portable spray apparatus that includes (a) a bottle reservoir for holding fluid, (b) a manually actuatable pump secured to the bottle reservoir, (c) an elongated fluid conveying tube having one end connected to the output of the pump and being in the form of a flexible loop section and an elongated output section, wherein the loop section is between the pump output and the output section, (d) an arm assembly for supporting the output section of the fluid conveying tube, and (e) a support rack for pivotally supporting the support arm and for retaining the support arm at different angular positions.

BRIEF DESCRIPTION OF THE DRAWINGS

The advantages and features of the disclosed invention will readily be appreciated by persons skilled in the art from the following detailed description when read in conjunction with the drawing wherein.

DETAILED DESCRIPTION OF THE DISCLOSURE

Figure 1:
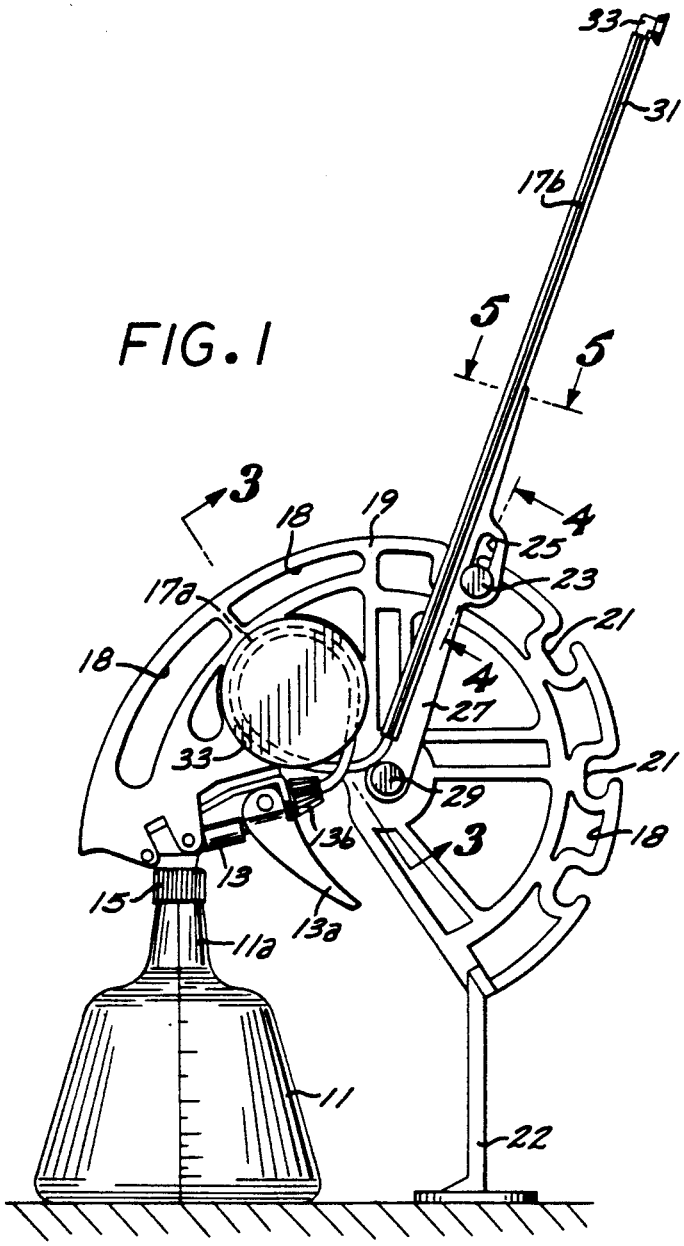
FIG. 1 is a side elevational view of a portable spray apparatus in accordance with the invention.

In the following detailed description and in the several FIGURES of the drawing, like elements are identified with like reference numerals.

Figure 2:
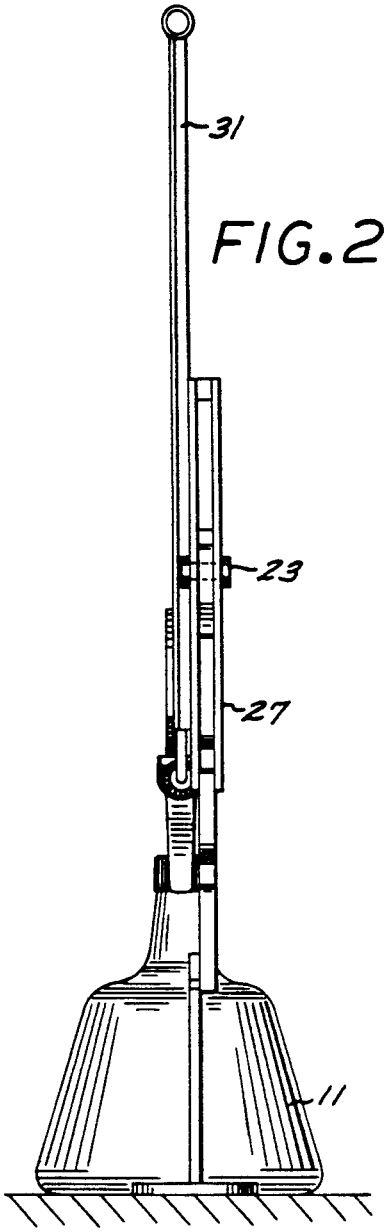
FIG. 2 is a front elevational view of the portable spray apparatus of FIG. 1.

Referring now to FIGS. 1 and 2, set forth therein are elevational views of a portable spray apparatus in accordance with the invention. The spray apparatus includes a bottle reservoir 11 for containing an amount of fluid. The bottle reservoir has a generally flat bottom to allow placement of the spray apparatus on a flat surface, for example for storage, and includes a neck portion 11*a* that ends in an opening. A hand actuated pump 13 is supported at the opening of the neck portion, for example, by an internally threaded cap 13 that is engaged with external threads formed on the neck portion adjacent the bottle opening. The pump 13 can be of conventional design as utilized for hand held spray bottles, and includes an actuating lever 13*a* that is actuated as the user holds the neck 11*a* of the bottle reservoir. User actuation of the lever 13*a* causes fluid in the reservoir to be drawn into the pump via a conventional input tube (not shown) that extends into the reservoir, and then discharged out of a pump output 13*b* into one end of a length of flexible tubing 17 which is in the form of (a) a flexure loop section 17*a* that is proximate the pump output and (b) an elongated output tube section 17*b* that is further away from the pump output such that the flexure loop section 17*a* is interposed between the pump output and the elongated tubing section 17*b*.

Figure 5:
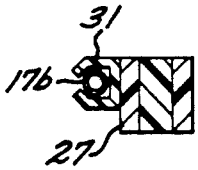
FIG. 5 is a sectional view of the elongated tubing retaining arm of the portable spray apparatus of FIG. 1.

The elongated output tube section 17*b* extends beyond the perimeter of a vertical generally flat support rack 19 which is supported by the pump, and is more particularly retained by the walls of an elongated channel member 31, shown in section in FIG. 5, which is secured to one of parallel pivot arms 27 that are located on either side of the flat support rack 19. A spray nozzle 33 is connected to the end of the elongated output tube section 17*b* that is beyond the perimeter of the flat support rack 19.

Figure 3:
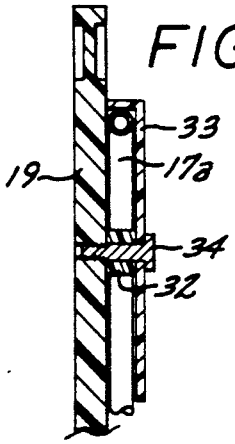
FIG. 3 is a sectional view illustrating the retention of a flexure loop formed of a portion the flexible fluid conveying tubing of the portable spray apparatus of FIG. 1.

The flexure tubing loop section 17*a* is retained close to the support rack by a loop retaining cover 33 such that the tubing loop 17*a* is generally parallel to the flat support rack 19. The loop retaining cover 33 is appropriately secured generally parallel to the support rack 19, for example, by a spacer 32 and a screw 34, as shown in FIG. 3. The flexure tubing loop section 17*a* flexes as the angle of the elongated output tube 16 is changed pursuant to pivoting of the pivot arms 27, which changes the distance and angle between the pump output and the portion of the output tube section 17*b* that is at the proximal end of the channel member. Effectively, the tubing loop 17*a* is a flexible fluid conveying structure that accomodates the change in distance and angle between the pump output and the portion of the output tube section at the proximal end of the channel member, where such distance and angle change with the angular position of the pivot arms 17*b*. It should be appreciated that while the tubing loop 17*a* and the output tube section 17*b* are disclosed by way of illustrative example as being a unitary length of flexible tubing, they can comprise separate elements, such as a tubing loop of flexible tubing connected to an output tube section, depending upon implementation. By virtue of the loop cover, the flexure tubing loop section 17*a* is neatly maintained close to the support rack 19 for all angles of the pivot arms.

The benefits of the flexure tubing loop section can be further appreciated by considering the use of a non-looped section of flexibile tubing instead of the flexure tubing loop. Such non-looped tubing would be of a length appropriate for the angular setting of the pivot arms 27 that requires the longest amount of flexible tubing between the pump output and the proximal end of the channel member, which would result in excess tubing for the angular setting of the pivot arms 27 that requires the shortest amount of flexible tubing between the pump outlet and the proximal end of the channeled member 31. Such excess tubing would be untidy and could interfere with the use of the spray apparatus.

The support rack 19 is generally flat and extends upwardly over the pump 13 and forwardly of the output of the pump 13. Depending on the size of the width of the base of the bottle reservoir 11 and weight of the support rack and the components supported thereby, a stand 22 can be secured to the lower portion of the support rack 19.

Figure 4:
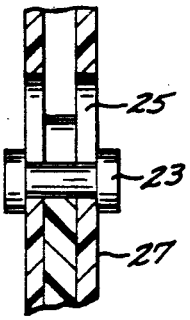
FIG. 4 is a partial sectional view of the angle positioning mechanism of the portable spray apparatus of FIG. 1.

The section of the support rack 19 that is forward of the pump includes a plurality of support slots 21 arcuately distributed in a circular arc along the perimeter of the forward support rack section. Each support slot 21 is configured to accommodate and retain the narrow central portion of a locking peg 23 which includes wide end sections and is slidably captured in parallel elongated slots 25 formed in the parallel pivoting arms 27, as shown in FIG. 4. The parallel pivoting arms are pivotally secured to the support rack by a pivot fastener 29 so as to be pivotable about a pivot axis that includes the center of the circular arc on which the support slots are distributed.

The parallel pivoting arms 27 extend beyond the perimeter of the support rack, and their non-pivotal ends are connected together so that the arms pivot as an integral unit. The parallel slots 25 are configured to allow the central portion of the locking peg 23 to be selectively positioned in one of the positioning slots 21 of the support rack 19 slots as well as beyond the perimeter of the support rack. The tubing retaining channel member 31 is secured to one of the parallel pivot arms 27 and extends beyond the ends thereof. Thus, the parallel pivot arms 27 and the elongated channel member 31 comprise a spray arm assembly which is pivotally positionable at different angles as determined by the angular locations of the positioning slots 21 relative to pivot axis of the pivot arms 27. Since the spray nozzle is located at the end of the elongated channel member 31, its angular position is determined by the angular position of the spray arm. Such angular position is changed by moving the locking peg to the outer end of the slot, pivoting the parallel support arms to align the peg with a one of the positioning slots, and then moving the locking peg to the inner end so that it can rest in the selected slot.

In addition to the support slots 21, the support rack 19 conveniently includes a plurality of apertures 18 distributed about the extent of the rack for reducing the weight of the rack also providing means by which the spray apparatus can be suspended for storage. Thus, the support rack comprises a simple and efficient mechanism for adjustably positioning the pivot arms at different angles, and also serves as a means of storage of the spray bottle apparatus. The support rack further allows for the simple containment of the flexure tubing loop section as a fluid conveying flexure that flexes with adjustment of the output tube angle.

The foregoing has been a disclosure of a portable spray apparatus that includes an extended spray arm having a spray nozzle at its end and which is easily positioned over a large angular range. The portable spray apparatus in accordance with the invention is of light weight, well balanced, easy to use and store, and is readily used by persons who have limited ranges of motion. Moreover, by virtue of the hand actuated pump, a portable spray apparatus in accordance with the invention provides for a consistent amount of water output for each complete stroke of the pump lever, which can be specified to the user such that plants are precisely watered to avoid over-watering and thereby conserve water.

Although the foregoing has been a description and illustration of specific embodiments of the invention, various modifications and changes thereto can be made by persons skilled in the art without departing from the scope and spirit of the invention as defined by the following claims.

What is claimed is:

1. A portable spray apparatus comprising:

a bottle reservoir for holding fluid;

a manually actuatable pump secured to said bottle reservoir, said pump having an output;

a vertical flat support rack secured to said pump and containing a plurality of slots arcuately distributed about its periphery;

a pivoting arm pivotally secured to said vertical flat support rack and pivotally positionable adjacent any one of said slots;

locking means selectively engageable in one of said slots for maintaining the position of said pivoting arm relative to said support rack; and a fluid conveying tube having one end connected to the output of said pump and having a flexible flexure loop section and an elongated output section, wherein said flexible loop section is between the end connected to the output of the pump and the elongated output section, said flexible flexure loop section being retained to be generally parallel to said support rack, and wherein the elongated output section is supported by said pivoting arm and extends beyond the perimeter of said flat support rack.

2. A portable spray apparatus comprising:

a bottle reservoir for holding fluid;

a manually actuatable pump secured to said bottle reservoir, said pump having an output;

a fluid conveying tube having one end connected to the output of said pump and having a flexible flexure loop section and an elongated output tube section, wherein said flexible flexure loop section is between the end connected to the output of the pump and the elongated output section;

a vertical flat support rack secured to said pump and containing a plurality of slots arcuately distributed about its periphery;

a pivoting arm pivotally secured to said vertical flat support rack and pivotally positionable adjacent any one of said slots, said pivoting arm supporting said elongated output tube section; and locking means selectively engageable in one of said slots for maintaining the position of said pivoting arm relative to said support rack.

3. A portable spray apparatus comprising:

a bottle reservoir for holding fluid;

a manually actuatable pump secured to said bottle reservoir, said pump having an output;

an elongated fluid conveying tube having first and second ends wherein the second end is further from said pump than the first end;

a vertical flat support rack secured to said pump and containing a plurality of slots arcuately distributed about its periphery;

a pivoting arm pivotally secured to said vertical flat support rack and pivotally positionable adjacent any one of said slots, said arm supporting said elongated fluid conveying tube;

locking means selectively engageable in one of said slots for maintaining the position of said pivoting arm relative to said support rack; and a flexible flexure tubing loop having one end connected to the pump output and having its other end connected to the first end of said elongated fluid conveying tube.

* * * * *